US011612778B2

(12) United States Patent
Liberatore

(10) Patent No.: US 11,612,778 B2
(45) Date of Patent: Mar. 28, 2023

(54) PNEUMATIC EXERCISE APPARATUS

(71) Applicant: Joseph Liberatore, Denver, CO (US)

(72) Inventor: Joseph Liberatore, Denver, CO (US)

( * ) Notice: Subject to any disclaimer, the term of this patent is extended or adjusted under 35 U.S.C. 154(b) by 0 days.

(21) Appl. No.: 17/701,233

(22) Filed: Mar. 22, 2022

(65) Prior Publication Data

US 2022/0305321 A1 Sep. 29, 2022

Related U.S. Application Data

(60) Provisional application No. 63/164,691, filed on Mar. 23, 2021.

(51) Int. Cl.
*A63B 21/008* (2006.01)
*A63B 23/035* (2006.01)
*A63B 21/00* (2006.01)

(52) U.S. Cl.
CPC ..... *A63B 21/0087* (2013.01); *A63B 21/4035* (2015.10); *A63B 23/0355* (2013.01)

(58) Field of Classification Search
CPC ..... A63B 21/00058; A63B 21/00069; A63B 21/00076; A63B 21/00178; A63B 21/002; A63B 21/0023; A63B 21/008; A63B 21/0083; A63B 21/0085; A63B 21/0087; A63B 21/02; A63B 21/04; A63B 21/0407; A63B 21/0414; A63B 21/0421; A63B 21/0428; A63B 21/0435; A63B 21/0442; A63B 21/16; A63B 21/4027; A63B 21/4033; A63B 21/4035; A63B 21/4045; A63B 21/4047; A63B 21/4049; A63B 23/035; A63B 23/0355; A63B 71/0054; A63B 2071/0063; A63B 2071/0072; A63B 2225/09; A63B 2225/093
See application file for complete search history.

(56) References Cited

U.S. PATENT DOCUMENTS 4,746,115 A * 5/1988 Lahman ..... A63B 21/4031 482/138
4,880,230 A * 11/1989 Cook ..... A63B 21/4047 482/113
5,385,524 A * 1/1995 Jahoda ..... A63B 21/4025 482/112
8,348,815 B2 * 1/2013 Signorino ..... A63B 69/20 482/84
10,357,679 B1 * 7/2019 Volk ..... A63B 21/0555
10,456,615 B1 * 10/2019 Anthony ..... A63B 21/4029
(Continued)

FOREIGN PATENT DOCUMENTS

AU 2009101024 A4 * 11/2009 ..... A63B 21/0087
DE 19546609 A1 * 6/1997 ..... A63B 23/0211
(Continued)

*Primary Examiner* — Gary D Urbiel Goldner
(74) *Attorney, Agent, or Firm* — Hall Estill Law Firm

(57) ABSTRACT

A pneumatic exercise apparatus that includes a pressure cylinder for providing a desired level of pneumatic resistance to pulling or pushing on a handle apparatus supported by the pressure cylinder. The apparatus also includes a tilt adjustment assembly that permits the pressure cylinder to rotate freely in the lateral direction and locked at a desired angle in the vertical direction. A method of training an exerciser to use the pneumatic exercise apparatus that includes the step of instructing an exerciser how to use the pneumatic exercise apparatus.

14 Claims, 6 Drawing Sheets

(56) References Cited

U.S. PATENT DOCUMENTS

| | | | | |
|---|---|---|---|---|
| 10,486,012 | B2 * | 11/2019 | Meredith | A63B 21/4033 |
| 2002/0086778 | A1 * | 7/2002 | Yu | A63B 21/1609 482/112 |
| 2002/0160890 | A1 * | 10/2002 | Fazio | A63B 21/00072 482/112 |
| 2003/0017920 | A1 * | 1/2003 | Fazio | A63B 21/0087 482/112 |

FOREIGN PATENT DOCUMENTS

| | | | | |
|---|---|---|---|---|
| KR | 860003211 | Y1 * | 11/1986 | A63B 23/12 |
| WO | WO-2010067034 | A2 * | 6/2010 | A63B 21/0058 |

* cited by examiner

PNEUMATIC EXERCISE APPARATUS

CROSS-REFERENCE TO RELATED APPLICATIONS

The present application is a conversion of U.S. Provisional Application having U.S. Ser. No. 63/164,691, filed Mar. 23, 2021, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a pneumatic exercise apparatus with multi-variability that permits unique exercises to be performed due to the numerous variability thereof.

2. Description of the Related Art

Typically, pneumatic exercise devices are set up to with provide resistance in only one direction and can be mounted in a limited manner. The limited manner in which it can be mounted prohibits typical pneumatic exercise devices from being used for many exercises. The single direction resistance of typical pneumatic exercise devices also limits the operability and limits their desirability as exercise equipment.

Accordingly, there is a need for a pneumatic exercise apparatus that can have significant adjustability to provide an exerciser with multiple exercise options.

SUMMARY OF THE DISCLOSURE

The present disclosure is directed to a pneumatic exercise apparatus. The apparatus includes a pressure cylinder for providing a desired level of pneumatic resistance to pulling or pushing on a handle apparatus supported by the pressure cylinder. The apparatus also includes a tilt adjustment assembly that permits the pressure cylinder to rotate freely in the lateral direction and locked at a desired angle in the vertical direction.

The present disclosure is also directed to a method of training an exerciser to use the pneumatic exercise apparatus. The method includes the step of instructing an exerciser how to use the pneumatic exercise apparatus.

DETAILED DESCRIPTION OF THE DISCLOSURE

Figure 1A:
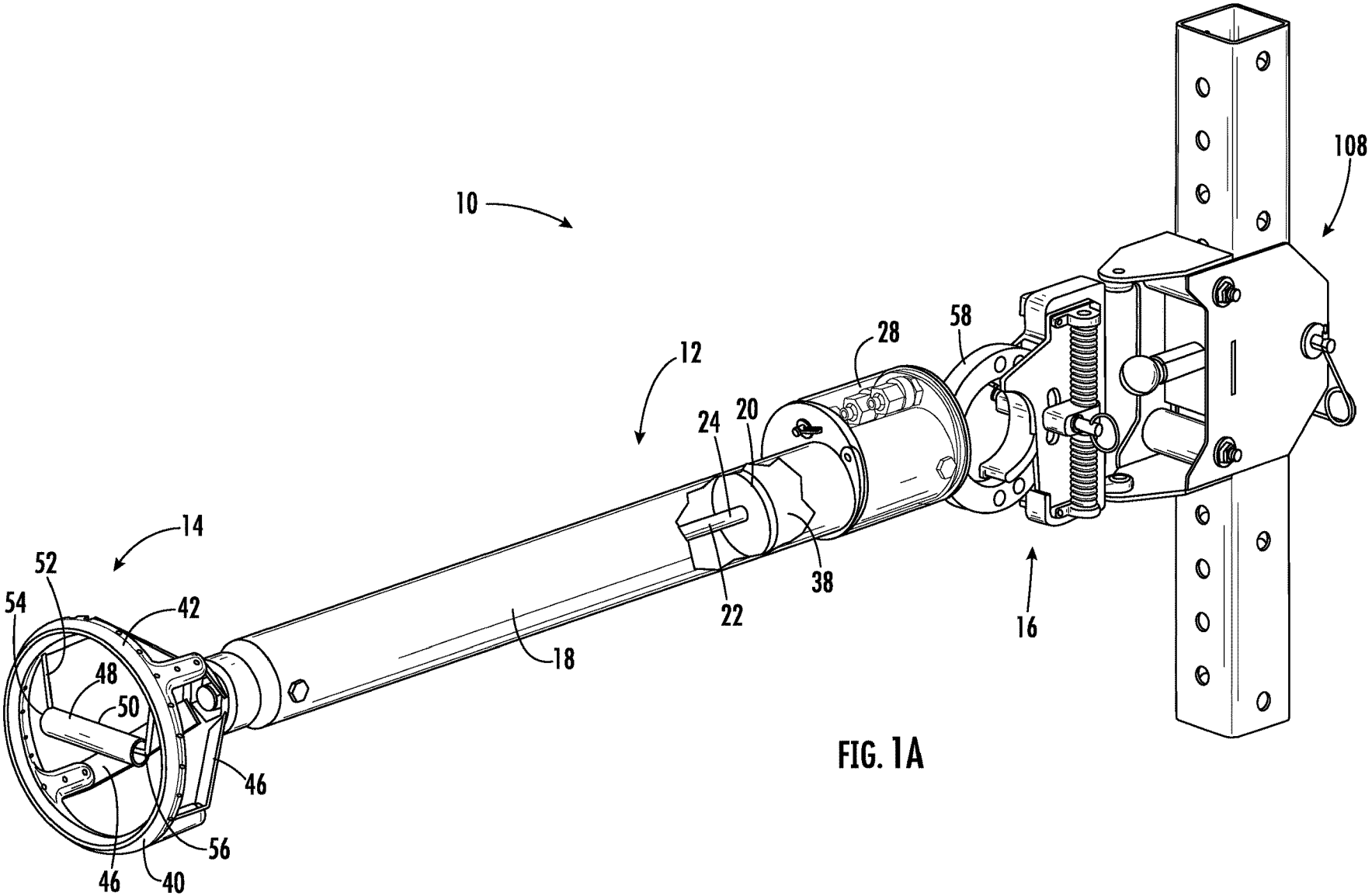
FIG. 1A is a perspective view of a pneumatic exercise apparatus in a retracted position constructed in accordance with the present disclosure.
Figure 1B:
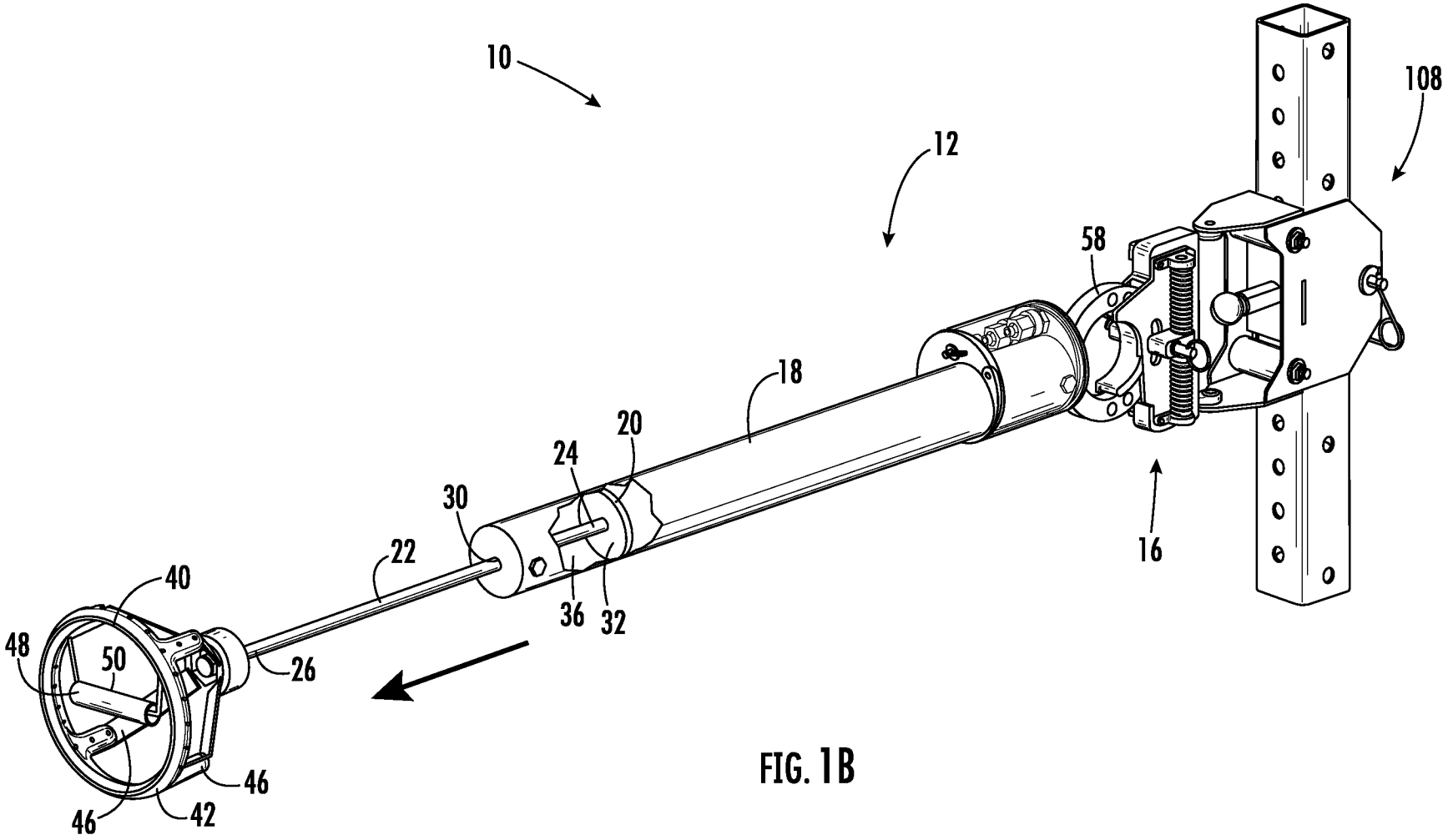
FIG. 1B is a perspective view of the pneumatic exercise apparatus in an extended position constructed in accordance with the present disclosure

The present disclosure relates to a pneumatic exercise apparatus 10 that has multi-variable adjustability and a method of instructing/training an exerciser how to use the pneumatic exercise apparatus 10. The pneumatic exercise apparatus 10 includes a pressure cylinder 12 for providing resistance pressure for the exerciser using the pneumatic exercise apparatus 10, a handle apparatus 14 secured to one end of the pressure cylinder 12 for providing the exerciser a means for engaging with the pneumatic exercise apparatus 10 and a tilt adjustment assembly 16 for adjusting the handle apparatus 14 and pressure cylinder 12 at a desirable position for a particular exercise.

The pressure cylinder 12 includes a sealed pressure chamber 18 with a piston head 20 slidably disposed therein, a rod 20 attached to the piston head 20 on a first end 24 of the rod 22 and the handle apparatus 14 on a second end 26 of the rod 22, and a pressure flow apparatus 28 to restrict and direct the flow of air in a desirable way so that the desired resistance, direction and quantity, is achieved for a particular exercise. The piston head 20 is sealingly disposed in the pressure chamber 18 such that air cannot pass around, or by, the piston head 20. Similar to the piston head 20, the rod 22 can slide in and out of an opening 30 disposed in the pressure chamber 18 and the rod 22 sealingly engages the opening 30 in the pressure chamber 18 such that air cannot escape the pressure chamber 18 as the rod 22 slides in and out of the pressure chamber 18.

The pressure flow apparatus 28 of the pneumatic exercise apparatus 10 can be configured to create a desired amount of resistance on a first side 32 of the piston head 20 or a second side (not visible) of the piston head 20. The first side 32 of the piston head 20 corresponds to a first compartment 36 of the pressure chamber 18 and the second side of the piston head 20 corresponds to a second compartment 38 of the pressure chamber 18. The first compartment 36 is the side of the piston head 22 closest to the handle apparatus 14 and the second compartment 38 is the side of the piston head 20 opposite the handle apparatus 14. The first and second compartments 36 and 38 vary in size depending upon the position of the piston head 20 inside the pressure chamber 18. The pressure flow apparatus 28 can vary the resistance of the air escaping the first or second compartment 36 or 38, which varies the resistance of the handle apparatus 14. For example, the rod 22 (and handle apparatus 14) might be in an extended position (either partially or fully) and the air in the second compartment 38 is constrained as it escapes the pressure chamber 18, the handle apparatus 14 encounters resistance and requires effort from the exerciser to push the handle apparatus 14 back towards the pressure chamber 18. Furthermore, if the air in the second compartment 38 is less constrained, then it will take less effort from the exerciser to push the handle apparatus 14 back towards the pressure chamber 18.

Figure 1C:
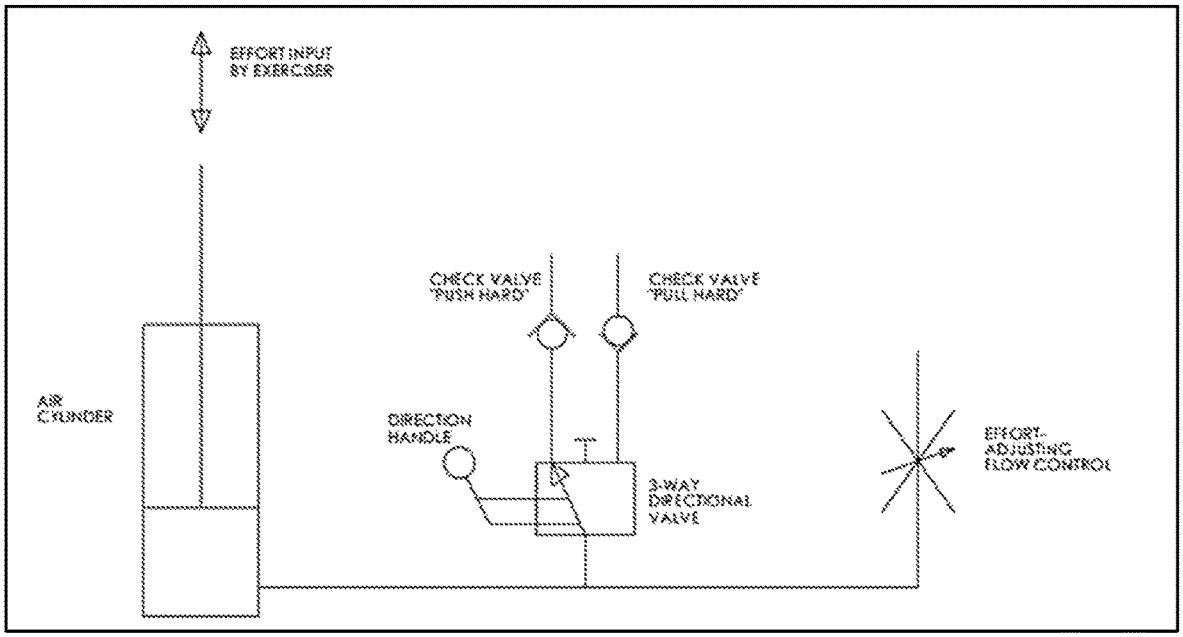
FIG. 1C is an exemplary flow diagram for the pneumatic exercise apparatus.
Figure 2B:
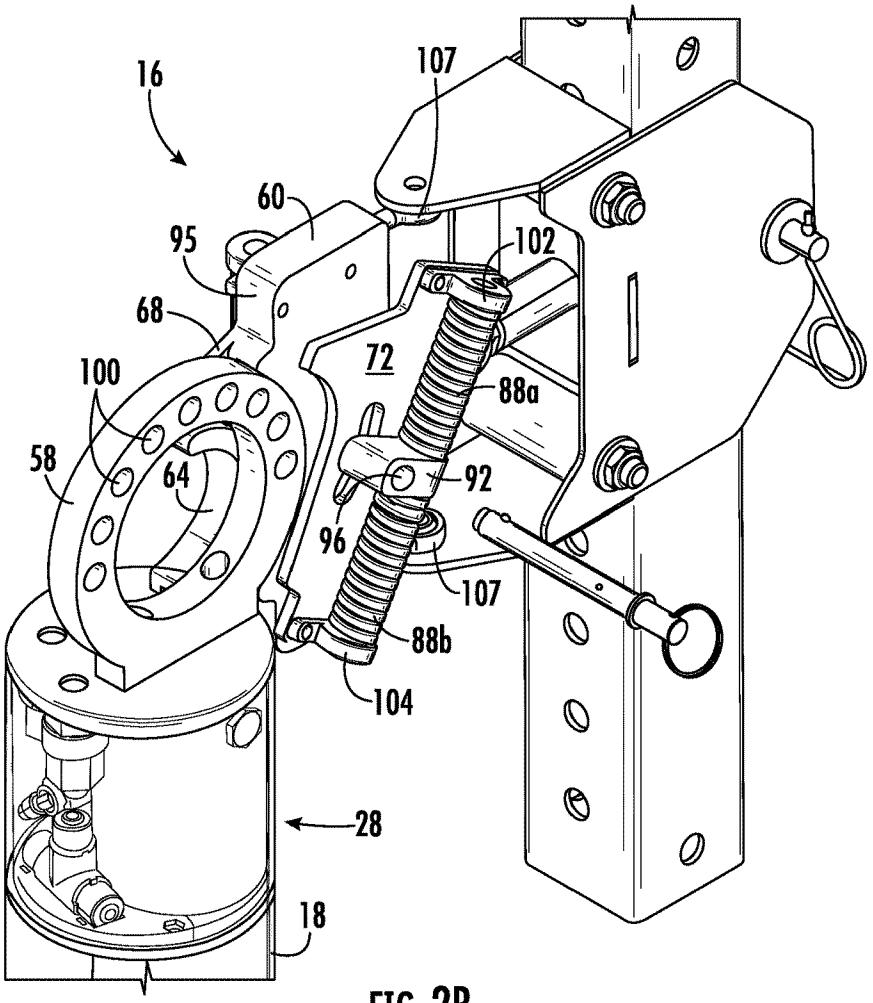
FIGS. 2A-2D are perspective views of a portion of the pneumatic exercise apparatus constructed in accordance with the present disclosure.
Figure 2A:
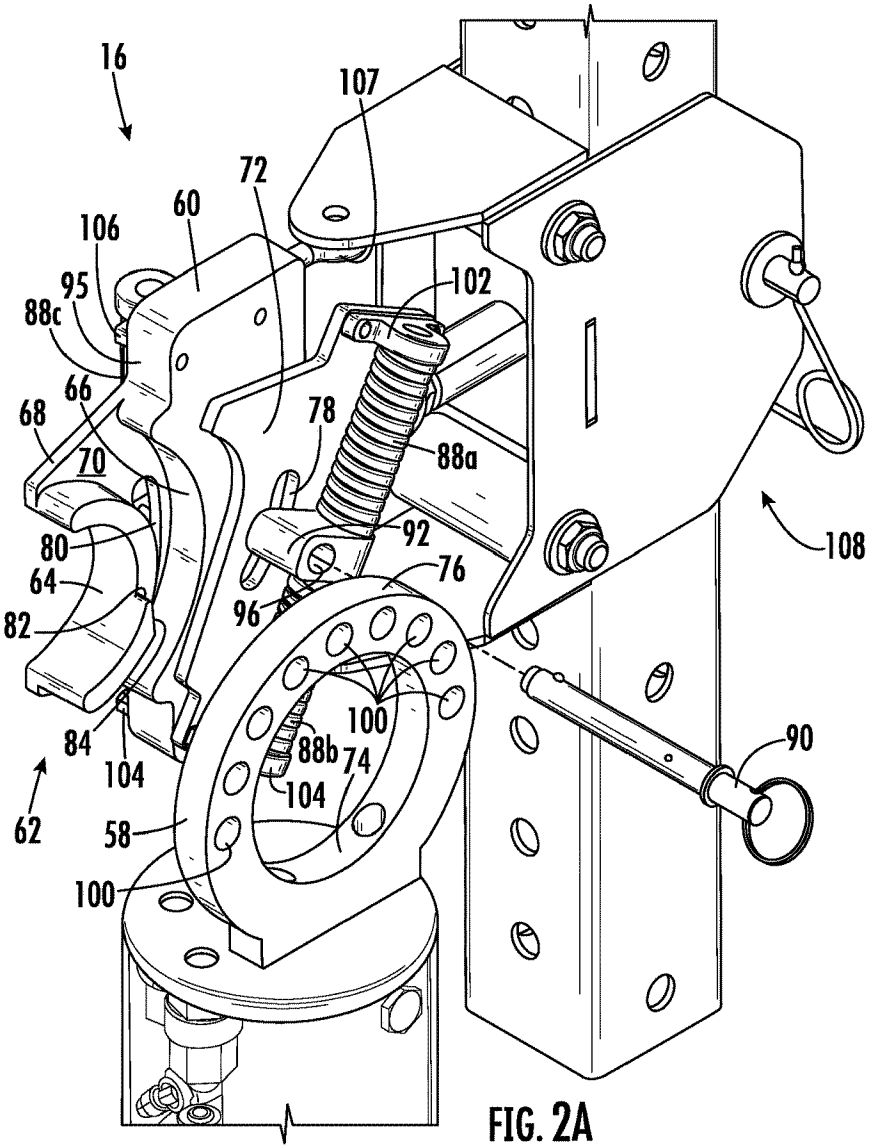
Figure 2D:
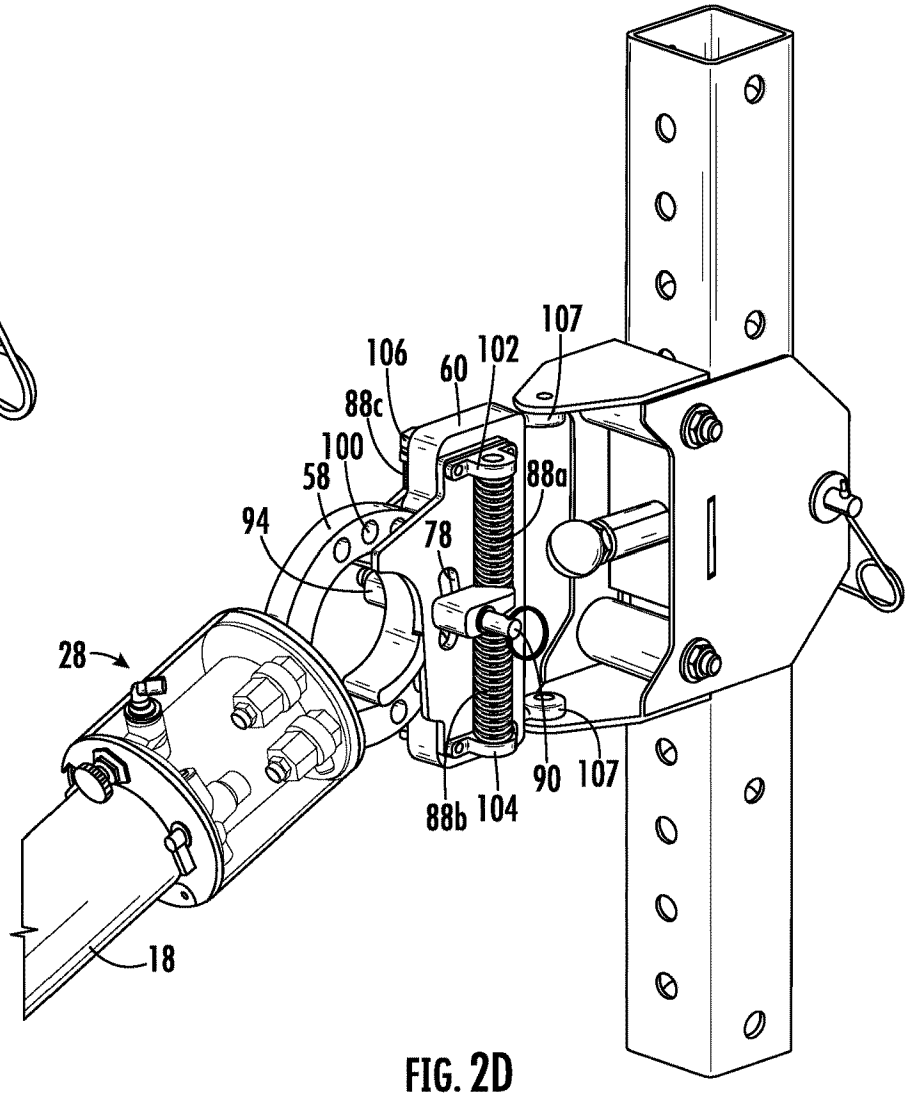
Figure 2C:
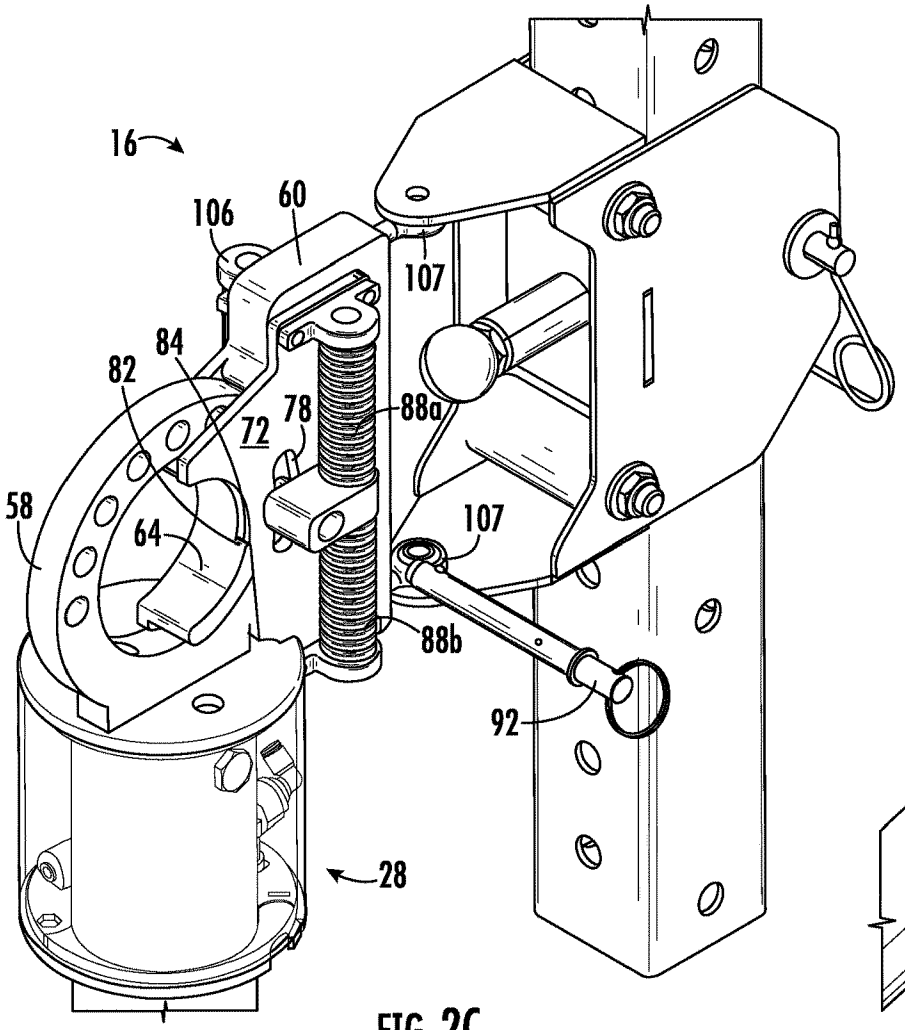
Figure 3B:
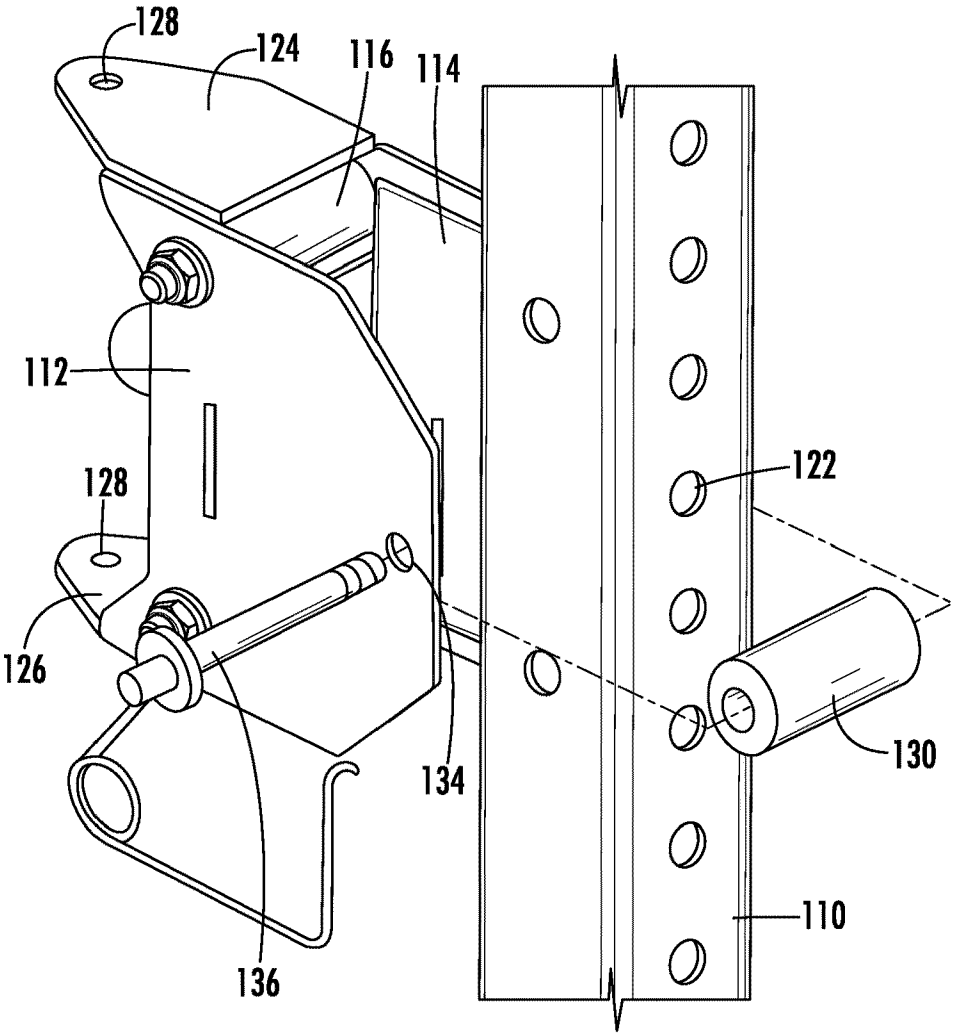
FIGS. 3A and 3B are perspective views of another part of the pneumatic exercise apparatus constructed in accordance with the present disclosure.
Figure 3A:
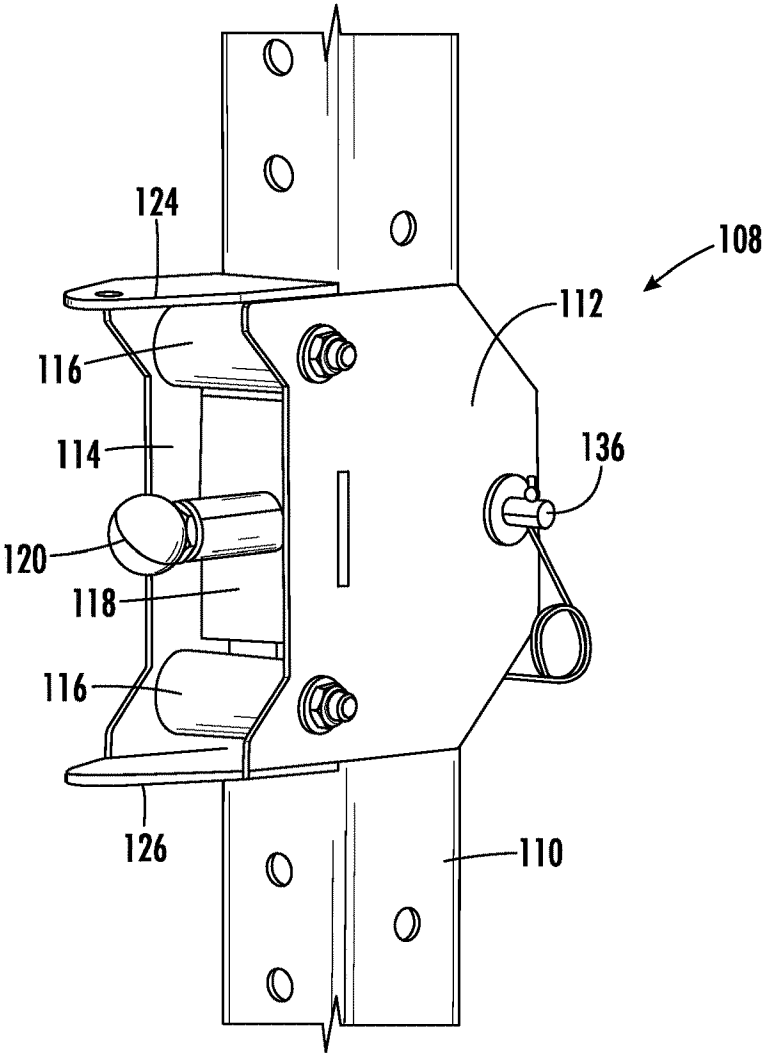

Conversely, if the handle apparatus 14 (and the rod 22) is in a retracted position (either partially or fully) and the air in the first compartment 36 is constrained as it escapes the pressure chamber 18, the handle apparatus 14 encounters resistance and requires effort from the exerciser to pull the handle apparatus 14 away from the pressure chamber 18. Furthermore, if the air in the first compartment 36 is less constrained, then it will take less effort from the exerciser to pull the handle apparatus 14 away from the pressure chamber 14. The pressure flow apparatus 28 can be configured such that there is a desired resistance in either directions, or only a single direction. The pressure flow apparatus 28 can also be configured such that the resistance can be varied. A flow diagram of the pressure flow apparatus 28 is shown in FIG. 1C.

The handle apparatus 14 can include an outer handle 40 that is attached to one end of the rod 22. The outer handle 40 can be any size and shape such that an exerciser can grasp different sections of it for various exercises. In one embodiment, the outer handle 40 is a ring portion 42 having a desired radius wherein a center of the outer handle 40 is in line with a centerline that would extend through the pressure cylinder 18. The outer handle 40 can be connected to the rod 22 via any manner known in the art, such as rod elements 46 that extend from the rod 22 to the outer handle 40, or ring 42 of the outer handle 40. The handle apparatus 14 can also include an inner handle 48 (floating) that is disposed inside the outer handle 40 and supported by the outer handle 40, but is not static. In one embodiment, the inner handle 48 is a cylindrical member 50 that is supported by the outer handle 40 via a first piece of flexible material 52 disposed on a first end 54 of the inner handle 48 that is attached to the outer handle 40 and a second piece of flexible material 56 disposed on a second end 58 of the cylindrical member 50 of the inner handle 48 that is attached to another part of the outer handle 40. In another embodiment, the inner handle 48 can be a hollow, cylindrical shape wherein a single piece of flexible material attached to the outer handle 40 in two separate locations and extends through the hollow, cylindrically shaped inner handle 48.

The tilt adjustment assembly 16 is used to allow an exerciser to articulate the exercise cylinder 12 through a variety of angles and motions. The tilt adjustment assembly 16 is releasably secured to a ring member 58 secured to the end of the pressure cylinder 12 opposite that of the handle apparatus 14. The tilt adjustment assembly 16 includes a base plate 60 for providing structural support of the pressure cylinder 12 and engaging with the ring member 58 of the pressure cylinder 12. The base plate 60 can have an engagement portion 62 extending from the base plate 60 to receive the ring member 58 of the pressure cylinder 12. The engagement portion 62 can include an inner arc member 64 and an outer arc member 66 disposed on a plate member 68. The layout of the inner arc member 64 and the outer arc member 66 creates a curved channel 70 between the inner arc member 64 and the outer arc member 66. The curved channel 70 receives a portion of the ring member 58 of the pressure cylinder 12. The tilt adjustment assembly 16 can also include a locking plate 72 that is attachable to one side of the base plate 60 to secure the ring member 58 in the curved channel 70 of the engagement portion 62. The ring member 58 is secured between the plate member 68 of the engagement portion 62 on one side and the locking plate 72 on the other side, the inner arc member 64 on the inside 74 of the ring member 58 and the outer arc member 66 on the outside 76 of the ring member 58. In one embodiment, the engagement portion 62 is oriented such that the ring member 58 is vertically disposed. In another embodiment, the tilt adjusting assembly 16 is designed such that the ring member 58 can be horizontally disposed when engaging the tilt adjustment assembly 16.

The locking plate 72 can include a curved slot 78 therein that is in alignment with at least a portion of the curved channel 70 of the engagement portion 62 and in general alignment with a curved slot 80 disposed in the plate member 68 of the engagement portion 62. The inner arc member 64 can have a flanged portion 82 that is wider than the inner arc member 64. The flanged portion 82 has a shoulder 84 that abuts a front edge 86 of the locking plate 72 so that the locking plate 72 can provide support for the ring member 58. The front edge 86 of the locking plate 72 can be shaped such that it is curved to match the curve of the inner arc member 64 from the point at which the front edge 86 is contacted by the shoulder 84 of the flanged portion 82 of the inner arc member 64.

The tilt adjustment assembly 16 can also include counter balance springs 88 to support the pressure cylinder 12 at a desired angle and an angle locking pin 90 to secure the pressure cylinder 12 at a desired angle. The tilt adjustment assembly 16 can have a first locking pin support element 92 disposed adjacent to the locking plate 72 and a second locking pin support element 94 disposed adjacent to the plate member 68 of the engagement portion 62 extending from a base portion 95. The first and second locking pin support elements 92 and 94 can have laterally disposed openings 96 therein that are in alignment with each other and in alignment with at least a part of the curved slot 78 in the locking plate 72 and at least a portion of the curved slot 80 disposed in the plate member 68 of the engagement portion 62. The locking pin 90 can be extended through the opening 96 in the first locking pin support element 92, the curved slot 78 in the locking plate 72, one of a plurality of openings 100 in the ring member 58 of the pressure cylinder 12, the curved slot 80 in the plate member 68 of the engagement portion 62, and the opening in the second locking pin support element 94. The multiple holes 100 in the ring member 58 offer several points wherein the locking pin 90 can engage the ring member 58 to position the pressure cylinder 12 at a desired angle. The curved slots 78 and 80 in the locking plate 72 and the plate member 68 of the engagement portion 62 provide the pressure cylinder 12 the ability to move a little up and down. The ring member 58 can have enough openings 100 therein that allows the pressure cylinder 12 to be mounted straight down and straight up.

The locking plate 72 can have an upper bracket 102 and a lower bracket 104 that extends from one side of the locking plate 72. The tilt adjustment assembly 16 can include a first spring 88*a* disposed between the upper bracket 102 and the first locking pin support element 92, and a second spring 88*b* disposed between the first locking pin support element 92 and the lower bracket 104. The tilt adjustment assembly 16 can also include a second upper bracket 106 and a second lower bracket (not shown) that extends from the other side of the base portion 95. The tilt adjustment assembly 16 could include a third spring 88*c* disposed between the second upper bracket 106 and the second locking pin support element 94, and a fourth spring (not shown) disposed between the second locking pin support element 94 and the second lower bracket. The springs 88 counter balance and support the pressure cylinder 12 when the pressure cylinder 12 is locked into a particular angle. Pins (not shown) can extend through the springs 88 described herein. The locking plate 72 could be positioned between one set of upper and lower brackets and the base portion 95 in certain embodiments. The base portion 95 can be adapted to be attached to anything, such as another piece of exercise equipment, wall, etc. In one embodiment, the base portion 95 has rotation bearings 107 that extend from the back of the base plate 60 so that the tilt adjustment assembly 16, and thus the pressure cylinder 12, can rotate laterally.

In a further embodiment of the present disclosure, the pneumatic exercise apparatus 10 includes an adjustable mounting assembly 108 for securing the pneumatic exercise apparatus 10 to a piece of exercise equipment 110, such as a squat rack. The adjustable mounting assembly 108 can include a first and second plate 112 and 114 that has two front rollers 116 disposed therebetween for engaging one side of the leg of the squat rack 110. The adjustable mounting assembly 108 can also include a cross plate 118 that extends between the first and second plates 112 and 114 and can support a pull spring pin 120. The pull spring pin 120 can engage one of the numerous openings 122 in the support legs 110 of the squat rack. The adjustable mounting assembly 108 can also include an upper plate 124 and a lower plate 126 with openings 128 therein to engage the rotation bearings 107 of the tilt adjustment assembly 16 to permit the pressure cylinder 12 to rotate laterally. The adjustable mounting assembly 108 can also include a removable third roller 130 disposed between the first and second plate 112 and 114 that can engage the back of the leg 110 of the squat rack. The third roller 130 has an opening 132 that extends therethrough that is in alignment with a hole 134*a* in the first plate 112 and a hole 134*b* in the second plate 114. A roller pin 136 can be extended through the hole 134*a* in the first plate 112, the opening 132 in the roller 130 and the hole 134*b* in the second plate 114. The rollers 116 and 130 cooperate to permit the adjustable mounting assembly 108 to be raised and lowered on the leg 110 of the squat rack when the pull spring pin 120 is pulled out.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A pneumatic exercise apparatus, comprising:

a pressure cylinder for providing a desired level of pneumatic resistance to pulling or pushing on a handle apparatus supported by the pressure cylinder, the pressure cylinder having a ring member disposed thereon; and a tilt adjustment assembly that permits the pressure cylinder to rotate freely in a lateral direction and to be locked at a desired angle in a vertical direction, the tilt adjustment assembly includes a base plate comprising an engagement portion that receives the ring member, the engagement portion includes an inner arc member and an outer arc member that creates a curved channel that receives the ring member of the pressure cylinder.

2. The pneumatic exercise apparatus of claim 1 wherein the pressure cylinder includes a piston head sealingly and slidably disposed in a sealed pressure chamber and a rod extending from the piston head to the handle apparatus.

3. The pneumatic exercise apparatus of claim 1 wherein the handle apparatus has an outer handle supported by a rod and an inner handle supported by the outer handle.

4. The pneumatic exercise apparatus of claim 3 wherein the inner handle is supported by the outer handle via a flexible material.

5. The pneumatic exercise apparatus of claim 1 wherein the ring member is secured inside the curved channel via a locking plate securable to the base plate of the tilt adjustment assembly.

6. The pneumatic exercise apparatus of claim 5 wherein the ring member includes a series of laterally disposed openings that receives an angle locking pin of the tilt adjustment assembly to lock the pneumatic exercise apparatus at the desired angle in the vertical direction.

7. The pneumatic exercise apparatus of claim 1 further comprising an adjustable mounting assembly that is attachable to a static structure and rotatably supports the tilt adjustment assembly.

8. A method of training an exerciser, the method comprising:

instructing the exerciser how to use a pneumatic exercise apparatus, the pneumatic exercise apparatus comprising:

a pressure cylinder for providing a desired level of pneumatic resistance to pulling or pushing on a handle apparatus supported by the pressure cylinder, the pressure cylinder having a ring member disposed thereon; and a tilt adjustment assembly that permits the pressure cylinder to rotate freely in a lateral direction and to be locked at a desired angle in a vertical direction, the tilt adjustment assembly includes a base plate comprising an engagement portion that receives the ring member, the engagement portion includes an inner arc member and an outer arc member that creates a curved channel that receives the ring member of the pressure cylinder.

9. The method of claim 8 wherein the pressure cylinder includes a piston head sealingly and slidably disposed in a sealed pressure chamber and a rod extending from the piston head to the handle apparatus.

10. The method of claim 8 wherein the handle apparatus has an outer handle supported by a rod and an inner handle supported by the outer handle.

11. The method of claim 10 wherein the inner handle is supported by the outer handle via a flexible material.

12. The method of claim 8 wherein the ring member is secured inside the curved channel via a locking plate securable to the base plate of the tilt adjustment assembly.

13. The method of claim 12 wherein the ring member includes a series of laterally disposed openings that receives an angle locking pin of the tilt adjustment assembly to lock the pneumatic exercise apparatus at the desired angle in the vertical direction.

14. The method of claim 8 further comprising an adjustable mounting assembly that is attachable to a static structure and rotatably supports the tilt adjustment assembly.

* * * * *